US006910992B2

(12) United States Patent
Arguilez

(10) Patent No.: US 6,910,992 B2
(45) Date of Patent: Jun. 28, 2005

(54) TANDEM EXERCISER AND POWER GENERATOR

(75) Inventor: Arcadio C. Arguilez, 1447 Eagle Peak Ct., Chula Vista, CA (US) 91910-6821

(73) Assignee: Arcadio C. Arguilez, San Diego, CA (US)

( * ) Notice: Subject to any disclaimer, the term of this patent is extended or adjusted under 35 U.S.C. 154(b) by 0 days.

(21) Appl. No.: 10/272,226

(22) Filed: Oct. 15, 2002

(65) Prior Publication Data

US 2004/0072657 A1 Apr. 15, 2004

(51) Int. Cl.[7] ..... A63B 69/16
(52) U.S. Cl. ..... 482/61; 482/57; 482/62
(58) Field of Search ..... 482/51, 52, 57, 482/61, 62–65, 133–137

(56) References Cited

U.S. PATENT DOCUMENTS 1,909,002 A * 5/1933 Oehlberg ..... 482/62
4,233,844 A * 11/1980 Dreisinger et al. ..... 73/379.06
4,616,823 A * 10/1986 Yang ..... 482/57
4,768,777 A * 9/1988 Yang ..... 482/57
4,919,416 A * 4/1990 DeCloux ..... 482/53
5,191,809 A * 3/1993 Craig ..... 74/572
5,247,853 A * 9/1993 Dalebout ..... 74/572
5,951,442 A * 9/1999 Adams et al. ..... 482/57

* cited by examiner

*Primary Examiner*—Stephen R. Crow
*Assistant Examiner*—Tam Nguyen

(57) ABSTRACT

A tandem exerciser is described with two facing seats and two pedal cranks that cause tandem riders to face each other and pedal forwards. A mutually operable handlebar crank with opposing handles mechanically couples to pedals on both sides of the distal pedal crank. A single sprocket wheel concentrically attached to the proximal pedal crank is coupled by a twisted, figure-eight looped chain to one of two sprocket wheels coupled to the distal pedal crank. These opposing sprocket wheels are mounted to their respective pedal cranks so as to have opposite offset angles relative to vertical plane of frame. These offset angles prevent damaging physical contact between sides of chain. The remaining sprocket wheel of distal pedal crank is conventionally chain coupled to freewheel coupled to hub of flywheel. Optionally, a power generator is belt-coupled to outer rim of flywheel, to produce electrical, fluidic or motive power.

14 Claims, 2 Drawing Sheets

TANDEM EXERCISER AND POWER GENERATOR

FIELD OF THE INVENTION

The present invention relates generally to tandem exercisers, kits and methods thereof, for exercising two riders simultaneously so as to work the upper and lower portions of their bodies, and more particularly to human-powered tandem apparatus that optionally converts work or motion created by the users or riders into usable electric, fluidic, or motive power.

BACKGROUND OF THE INVENTION

As is known, various types of exercising devices and machines are popular in today's society. In recent decades, as the awareness of the importance of cardiovascular, skeletal muscle and aerobic training has risen, so too has demand increased for improved exercise equipment. Gyms and health clubs typically offer a variety of sophisticated and expensive equipment, such as stationary versions of bikes, recumbent bikes, treadmills, rowers, stair climbers or steppers, ellipticals and cross-country skiing. All of this equipment is designed and manufactured to be used by only one rider or user at a time. So, even though the public has become more aware that consistent and intelligently applied exercise can slow the effects of aging and thereby lengthen life span, overcome physical and metabolic disease, control weight and pre-disease states, there is little, if any, exercise equipment that encourages mutual, simultaneous use; provides social opportunities through its face-to-face contact; as well as mutually concurrent monitoring of user exercise. Specifically, there is little, if any exercise equipment that simulates popular forms of mutual or concurrent exercise and that allows face-to-face socialization.

Exercising the muscles of the body to increase the overall aerobic capacity, upper and lower body strength and stamina, and lean muscle mass of a single individual by combining forward leg pedaling with arm pumping free weights is one of the types of known exercise. However, arm pumping with free weights is often cumbersome, creating storage problems of the free weights, damage to floors and walls, and possible injuries to nearby individuals. In addition, arm pumping free weights is not easily coupled for objectively measuring exercise output. Therefore, there is a need for an exercise device, apparatus or exerciser that mechanically couples both arm pumping and forward leg pedaling. There is also a need for harnessing and transmitting this exercise power and converting or transducing it into usable power.

The development of devices that use cycling wheels or flywheels to provide the resistance for muscle contraction eliminated the problems inherent with handling free weights, but also created new ones. Even the classic tandem bicycle built for two riders does not allow for upper body exercise, and the riders both face the direction in which they travel, thereby making it difficult to socialize and monitor the performance of the other user. The tandem bicycle further limits the view of the rider that sits directly behind the lead rider, creating a situation where the forward view for the back rider never changes.

In the instant invention, the concept of using an exerciser where two riders face each other, so as to mutually encourage and monitor performance and output of the other rider, yet where each rider must pedal forward, is believed to be novel. The power transmission and transduction system described herein, requires mutual forward pedaling by both face-to-face users or riders and is also believed to be novel.

There is therefore a need to provide a new mechanical exerciser for working the upper and lower body portions of dual riders that overcomes the problem of one rider located directly behind and out of the line-of-sight of the other rider, and thereby not working or exercising equitably.

It is an object of the present invention to couple the mutual forward pedaling motion generated during tandem exercise of the upper and lower portions of the bodies of dual riders.

It is an object of the present invention to optionally couple the forward power generated during tandem physical exercise to a generator of electrical, fluidic (gas or liquid) or motive power, that would either be concurrently used or stored for future use.

It is another object of the present invention to provide an integrated two-person exerciser for optionally driving larger power generators for either immediate use or storage of this power.

It is still another object of the present invention to provide a dual human-powered apparatus for driving a variety of different makes and styles of power generators, power components, power equipment and other motive driven apparatus.

It is still yet another object of this invention to provide this tandem exerciser and power generator in a easily moved, easily stored, easy to use format, that is functionally tolerant of tandem users, capable of withstanding institutional usage encountered in universities, corporations, and commercial gyms, as well as third world countries.

It is still yet another object of this invention to provide this tandem exerciser and power generator as components or parts packaged in a kit or kits that are shipped to the retailer and/or customer and then assembled.

It is still yet another object of this invention to provide a method or methods for simultaneous tandem exercising and power generation.

The aforementioned background has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following illustrations, and the written disclosure of the Detailed Description of the Invention.

SUMMARY OF THE INVENTION

These and other objects of the invention are provided in a tandem exerciser for working the upper and lower bodies of two facing, forward pedaling riders, and for transmitting and transducing the motive power thereby generated into useful electrical, fluidic or mechanical power.

In the preferred embodiment, the tandem exerciser includes a frame, a suspended flywheel, two facing seats, and structural elements for supporting both ends of the frame. A power transmission and transduction system is comprised of a chain-and-sprocket system coupled to the flywheel, where the flywheel is belt coupled to a power generator producing twelve-volt D.C., A.C. electricity, or driving an air compressor, fluid pump, or other motive-powered systems.

A proximal pedal crank is chain coupled to a distal pedal crank, through two sprocket wheels coupled together by a synchronizing bicycle chain. This chain is twisted slightly less than one-hundred-eighty degrees, and mounted on the opposing sprocket wheels that are oppositely offset from the vertical plane of the frame. This offset prevents the chain from physically contacting and damaging itself. It also allows both pedal cranks to be forward pedaled by their respective facing riders. An alternating handlebar crank is also mechanically coupled to the distal pedal crank thereby harnessing exercise from the upper bodies of both riders.

This unique facing, forward pedaling feature of this invention allows tandem riders or users to closely monitor the exercise rate, or work level of the other user. Encouragement and other social action can then take place in a face-to-face manner.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the Invention, which includes the preferred embodiment.

DETAILED DESCRIPTION OF THE INVENTION

In the following detailed description, certain specific terminology will be employed for the sake of clarity and a particular embodiment described in accordance with the requirements of 35 U.S.C. §112, but it is to be understood that the same is not intended to be limiting and should not be so construed inasmuch as the invention is capable of taking many forms and variations within the scope of the appended claims.

The invention accordingly consists in the features of construction, combinations of elements, and arrangements of parts and members, which will be exemplified in the construction hereinafter described, and of which the scope will be indicated by the appended claims.

Figure 1:
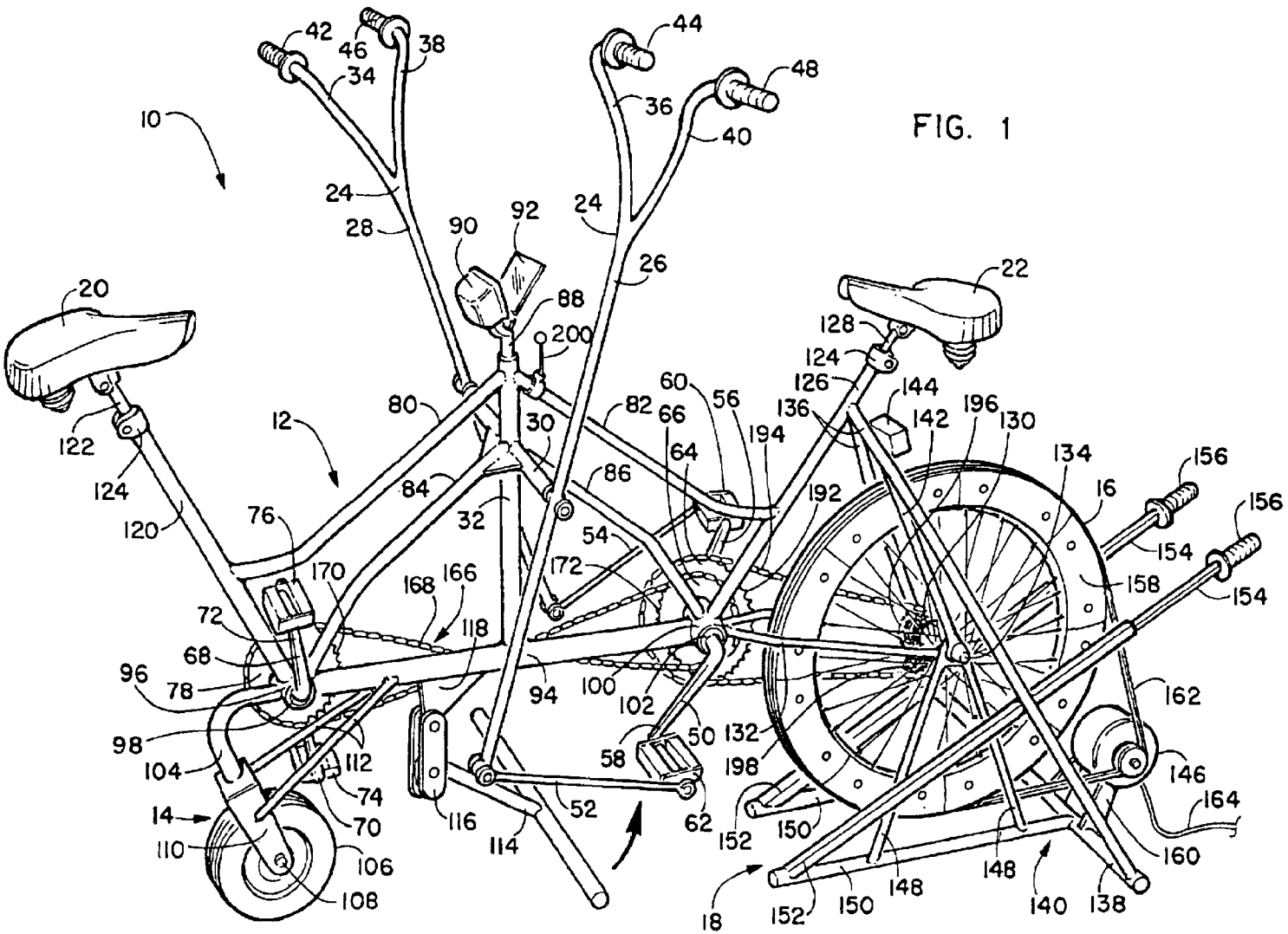
FIG. 1 is a perspective view of the present invention.

Referring now to the drawings, and specifically to FIG. 1 thereof, a tandem exerciser is generally designated 10 and includes frame 12 having proximal and distal ends, and near and far sides. Frame 12 is suspended between front wheel assembly 14 and flywheel 16. The flywheel 16 is suspended above the floor surface by gantry 18, which is the distal end portion of frame 12 attaching to, and supporting flywheel 16. The exerciser 10 also includes proximal saddle or seat 20, and distal saddle or seat 22, which allows tandem riders to directly face each other while exercising by forward leg pedaling and alternating arm pumping.

Continuing with FIG. 1, handlebar crank 24 is located on both near and far sides of frame 12. The handlebar crank 24 is constructed of two substantially vertical crank members 26, 28 described as columns or tubes, which alternately pivot or rock about their attachment at the opposing ends or end portions of perpendicular cross member 30. This cross member 30 is fixedly attached to the upper third portion of vertical frame column 32 or head tube that is centrally located on frame 12. The upper portions of the bilateral handlebar crank 24 includes handlebars 34, 36 extending toward the first or proximal rider sitting on proximal seat 20 and the opposing handlebars 38, 40 extending toward the second or distal rider sitting on distal seat 22. These handlebars 34, 36, 38, 40 extend upward and towards the upper body, shoulders or arms of the seated riders, respectively. Handlebars 36, 40 on the nearest side of frame 12, and handlebars 34, 38 on the furthest side of frame 12 are constructed to generally resemble a "Y"-shaped, "V"-shaped or "U"-shaped outline or form. These shapes are meant as typical examples, and shall not be construed as limiting.

The two riders control and manipulate handlebars 34, 36, 38, 40 by grasping handles 42, 44, 46, 48, respectively. During exercise the two riders alternately pump their arms by extending and contracting their arms against handles 42, 44, 46, 48 thereby moving handlebars 34, 36, 38, 40 and vertical crank members 26, 28 which alternately and longitudinally pivot both sides of handlebar crank 24. The distance between the human riders and handles 42, 44, 46, 48 and handlebars 34, 36, 38, 40 allows for a comfortable and efficient range of motion for the arms and shoulders of each rider. Upper body, shoulder and arm pumping applied by the tandem riders to the handlebar crank 24 is then transmitted and transduced into forward pedaling rotation of distal pedal crank 50. This movement transduction occurs at the bottom end of vertical crank members 26, 28 which are pivotally coupled to generally horizontal handlebar crank arms 52, 54 extending towards and pivotally coupled to the end portions of the respective pedal crank arms 56, 58.

The distal pedal crank 50 is constructed of pedal crank arms 56, 58 with pedals 60, 62 respectively attached thereon. First or outer sprocket wheel 64 and second or inner sprocket wheel 66 are centrally attached to pedal crank 50 which is coupled to frame 12 so as to allow rotation. Both distal sprocket wheels 64, 66 are located on the far side of frame 12.

The proximal pedal crank 68 is constructed of pedal crank arms 70, 72 with pedals 74, 76 respectively attached thereon. Sprocket wheel 78 is centrally attached to pedal crank 68 which is coupled to frame 12 so as to allow rotation. The proximal sprocket wheel 78 is located on the far side of frame 12.

The frame 12 normally lies in a generally vertical plane and includes upper frame members 80, 82 that are laterally spaced, longitudinally and downwardly extending in the opposing proximal and distal directions. Below the upper frame members 80, 82 are intermediate frame members 84, 86 that are also laterally spaced, longitudinally and downwardly extending in the opposing proximal and distal directions.

These frame members 82, 84, 86, 88 as well as all other frame members, are described as columns or tubes, by way of example and not limitation, whose thickness and density are determined by individual requirements of strength and weight, thereby requiring some members to be substantially solid or hollow cross-sectionally. All the individual members or pieces used in the construction of frame 12 may also have various cross-sectional shapes, by way of example and not limitation, such as circular, oval, elliptical, triangular, rectangular or square and perform their function with equal effectiveness. Typically, the outer diameters of the frame members may vary generally between 0.875 to 3.5 inches, by 0.125 inch increments.

All of the hardware of the tandem exerciser 10, especially frame 12 and its component members, columns or tubes may be made substantially of any rigid metal or combinations of metal, such as steel, Chromoly steel, iron and chromium and/or nickel-containing alloys, as well as aluminum, titanium or other weldable or heat-joinable metals. All component members of frame 12 may also be made lightweight by incorporating materials such as carbon-graphite fiber and/or metal-matrix composites, in whole or part.

The opposing longitudinal upper and intermediate frame members 80, 82, 84, 86 are connected at their centrally directed ends to generally upstanding vertical frame column 32, also referred to as head tube. Support post 88 is inserted into and is positionally secured to the upper end of head tube 32 by welding or post collar. This support post 88 is used for mounting at least one display meter or monitor.

Continuing with FIG. 1, voltage meter 90 and reflective mirror 92 are pivotally or hingeally mounted to the upper end of support post 88. The mirror 92 is reflectively juxtaposed to dial or face of the voltage meter 90 so as to allow the proximal rider to view voltage output as a type of performance output during exercise. Actual pedaling of the tandem exerciser 10 has yielded sustained voltages measured at seventeen volts D.C. by the voltage meter 90. The voltage meter 90 may be one or more analog meters, measuring zero-to-eighteen volts D.C., such as the Sunpro CP8205 Voltmeter from Actron (Cleveland, Ohio). Alternatively, one or more analog meters that measures volts A.C., or one or more digital display meters that measures and displays volts A.C. or D.C. may be used. Another approach, by way of example and not limitation, would be to use one or more digital display performance meters that measures exercise work output and then instantly calculates and displays distance traveled, calories burned, watts produced, actual time, exercise time, single and/or dual heart rates and/or other indications of work, exercise or performance output. Such digital display meters may be obtained from Concept2, Inc. (Morrisville, Vt.), Nielsen-Kellerman (Chester, Pa.) or Kettler (San Antonio, Tex.), or other manufacturers of these standard performance meters used with many well known stationary exercise systems. Alternatively, the meter may be measuring and displaying fluidic power or potential power from either air compressors, in units of PSI, Bar, $Kg/cm^2$, or KPA, or liquid pumps or motive power in revolutions per unit time. Either meter used would be connected electrically, optically or fluidically to one or more identical sensors or to different types of sensors measuring air pressure, fluid pressure, electrical output, or revolutions per unit time from the flywheel 16, either directly or indirectly.

FIG. 1 further teaches that the downward end of vertical frame column 32 is connected generally midway between the ends of horizontal frame member 94. Frame member 94 may also be referred to as cross tube or crossbar of frame 12. The proximal end of crossbar 94 is rigidly connected to bottom bracket shell 96 located at the proximal end of frame 12, through which the hub assembly 98 is secured and the proximal pedal crank 68 revolves. The distal end of crossbar 94 is rigidly connected to another bottom bracket shell 100 located at the more distal end of frame 12, through which hub assembly 102 is secured and the distal pedal crank 50 revolves.

Extending frame member 104 projects longitudinally and in the proximal direction from bottom bracket shell 96 and generally bends downward and connects into front wheel assembly 14 that is used to support the proximal end of tandem exerciser 10. This front wheel assembly 14 facilitates the roll-away and storage of the tandem exerciser 10 when not in use. The extending frame member 104 may be permanently fixed in position using welding methods, or alternatively, be adjustably secured in both longitudinal length and rotation using post collar. The front wheel assembly 14 is constructed from wheel 106, axle 108, and wheel bracket 110. The front wheel assembly 14 is reinforced and secured to the horizontal frame member 94 by at least one strut 112 or stays.

Collapsible kickstand 114 is connected through hinge assembly 116 to pylon 118 projecting downward from the horizontal frame member 94. The kickstand 114 is engaged after the tandem exerciser 10 is rolled to a desirable location, but before the riders mount their facing seats 20, 22. Kickstand 114 is shaped as an inverted "T" in order to provide overall mechanical stability and safety during exercise, or productive use. Other kickstand formats or shapes may be used such as "A"-shaped, or inverted "Y" or "U"-forms. These shapes are meant as typical examples, and shall not to be construed as limiting.

At the proximal end of frame 12, generally upstanding seat column 120, also referred to as seat tube, is rigidly and fixedly secured to the proximal end of the upper frame column 80 and to bottom bracket shell 96. The proximal ends of both the intermediate frame column 84 and crossbar 94 are also rigidly and fixedly attached to bottom bracket shell 96. Seat 20 is adjustably connected to seat post 122 which telescopes within seat column 120. Seat post 122 is vertically, horizontally and rotationally secured within seat column 120 by use of seat post collar 124 that may be tightened or expanded by turning an adjustment screw in the collar ends. Alternatively, seat post collars that use quick-release mechanisms and levers may also be used to secure seat post 122.

At the distal end of frame 12, another generally upstanding seat column 126, also referred to as seat tube, is rigidly and fixedly secured to the distal end of the upper frame column 82 and to bottom bracket shell 100. The distal ends of both the intermediate frame column 86 and crossbar 94 are also rigidly and fixedly attached to bottom bracket shell 100. Seat 22 is adjustably connected to seat post 128 which telescopes within seat column 126. Seat post 128 is vertically, horizontally and rotationally secured within seat column 126 by use of another seat post collar 124 that may be tightened or expanded by turning an adjustment screw in the collar ends. Again, an alternative approach may utilize seat post collars that incorporate quick-release mechanisms and levers to secure seat post 128.

As illustrated in FIG. 1, the proximal and distal seat columns 120, 126 may both be inclined rearwardly away from the respective ends of frame 12, for the comfort and proper foot placement of the users or riders.

Continuing with FIG. 1, the tandem exerciser 10 is suspended and supported at the distal end of frame 12 by a portion of the frame 12 designated as gantry 18. This gantry 18 also attaches to, and supports flywheel 16 by connection to rotatable axle 130. At least two chain stays 132 extends bilaterally, longitudinally and distally from the bottom bracket shell 100 and adjustably connects at their respective distal ends to the respective ends of axle 130 of flywheel 16. These chain stays 132, as well as other gantry members, are secured to their respective ends of axle 130 by axle nut 134. At least two gantry-seat frame members 136 or columns are fixedly attached to the upper portion of seat column 126 and extend downward in a distal direction and outward relative to the vertical plane of frame 12 toward a fixed connection with the opposing ends of perpendicular base member 138 of gantry base frame 140. At least one seat stay 142 on each side of frame 12 fixedly connects to the upper portion of each gantry-seat frame member 136 and extends downward so as to adjustably connect to the respective opposing ends of flywheel axle 130.

Socket box 144 that includes electrical socket and toggle switch, is attached between the upper portions of gantry-seat frame members 136. Alternatives to the electrical socket would include, but shall not be limited by, one or more twelve-volt D.C. output sockets, one or more A.C. output sockets, and/or one or more one-hundred-twenty volt A.C. sockets or outlets. The sockets or outlets are electrically connected to power generator 146 and/or to a twelve-volt battery or batteries electrically connected in series.

At least one pair of gantry-axle frame members 148 extend downwards and angularly outward from each end of the flywheel axle 130. Each pair of gantry-axle frame members 148 are fixedly connected on their side of frame 12, respectively, to about the middle third-portion of longitudinal base members 150 of gantry base frame 140.

Longitudinal columns 152 extend angularly upward in the distal direction from the respective proximal ends of the two longitudinal base members 150 of gantry base frame 140. Each longitudinal column 152 contains handle post 154 that adjustably telescopes so that the user can control the leverage needed to lift and roll-away the tandem exerciser 10. At the distal ends of each handle post 154 are grip handles 156.

Flywheel 16 is weighted near the outer rim or perimeter by using semicircular metal plate segments 158 securely attached to like metal plate segments on the opposing side of flywheel 16. Each metal plate segment 158 weighs between six and twenty-four pounds, with a typical weight of about twelve pounds. Foam rubber or other compressable material may be used to cushion and inhibit the plate segments 158 from rattling and/or shaking loose during use of the tandem exerciser 10. The added weight or mass of between eight-to-twenty-four plates further serves to regulate or equalize the rotational motion of the flywheel 16 by increasing the inertia of the flywheel 16 during use. Alternatively, the flywheel 16 may be a one-piece metal wheel machined or molded from a single metal or metal alloy, and resulting in a wheel approximately equivalent in total weight as the aforementioned flywheel 16.

Power generator 146 is secured by mounting bracket 160 to the perpendicular base member 138 of the gantry base frame 140. The power generator 146 is operationally coupled to the outer rim of flywheel 16 by flexible circular belt 162. In this embodiment, the belt 162 is eighty-four inches in circumference. This length is meant to be exemplary, and is not to be construed as limiting because the circumference of flywheel 16 and the coupling distance to power generator 146 will effect the actual circumference of belt 162. This circular belt 162 may be made of natural or synthetic materials. Commercially available examples of this circular belt 162 would include, but not be limited by, one or more conventional V-belts, drive belts or serpentine belts. Such belts are available from DAYCO (Tulsa, Okla.) and many other manufacturers and suppliers known to those skilled in the art. Primitive alternatives may include natural or synthetic rope, chain or gut materials fashioned into a makeshift belt. Alternatives to the belt system of power transmission and transduction would include direct gear-to-gear, or chain-and-sprocket systems.

The power generator 146 may be either twelve-volt D.C. generator, alternator (A.C. generator), air compressor or fluid pump. The twelve-volt D.C. electrical power may be stored in one or more twelve-volt batteries electrically connected by electrical cable 164 in series to the D.C. generator. The electrical power could also be stored in capacitors. The power generator 146 may be variously sized to match the work output from the tandem riders. An alternative to using an alternator would be to use a one-hundred-forty watt inverter that could be plugged into the twelve-volt D.C. socket of the socket box 144 and then produce one hundred twenty watts A.C. Such an inverter is available from RadioShack (Fort Worth, Tex.) as product number 22-145.

Alternatively, the motive power of the flywheel 16 itself may be directly harnessed and transduced for rotating or turning of various mechanically-powered equipment that mills, cuts or grinds various materials or objects.

Figure 2:
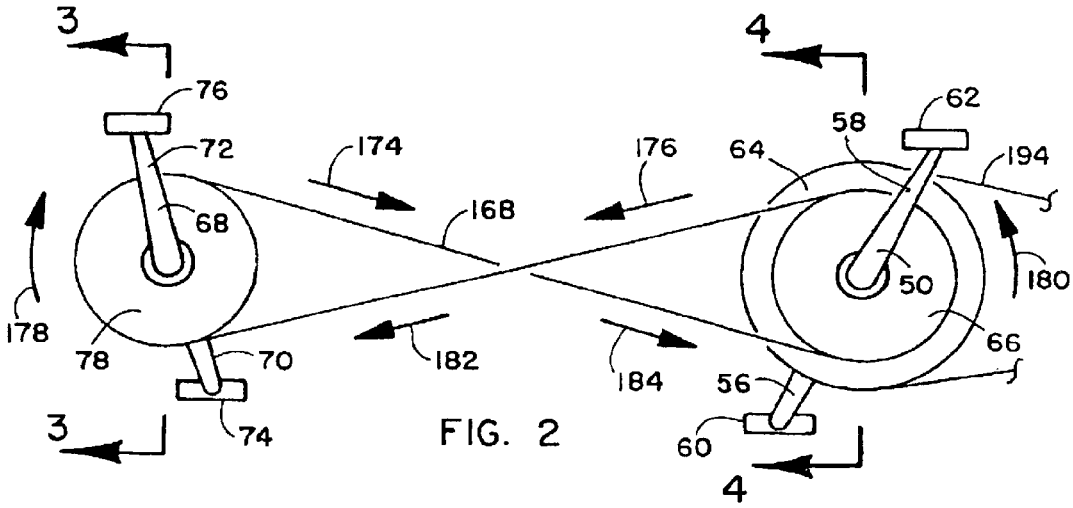
FIG. 2 is a simplified side view of the forward directional drive from the pedal cranks of the present invention.

Now turning mostly to FIG. 2, chain-and-sprocket system 166 is generally designated and is used to capture the work from two riders that are exercising their upper and lower bodies. This chain-and-sprocket system 166 is a portion of the overall power transmission and transduction system seen in FIG. 1 that may also incorporate flywheel 16, belt 162, and various power generators 146. As FIG. 2 teaches, this chain-and-sprocket system 166 is used to uniquely and simultaneously transmit and transduce power from the arm and leg pumping and forward leg pedaling from both the proximal and distal tandem riders.

As illustrated, in FIG. 2, this chain-and-sprocket system 166 is constructed from proximal sprocket wheel 78 fixedly coupled to pedal crank 68 having crank arms 70, 72 located bilaterally. Both crank arms 70, 72 are turned at the point of the attached pedals 74, 76 by the forward pedaling feet of the proximal rider. The proximal end of synchronizing chain 168 is engaged to a portion of about thirty-nine individual sprockets 170 or teeth, as seen in FIG. 1, and located around the perimeter of sprocket wheel 78. The number of sprockets per any sprocket wheel in the instant invention is only exemplary, and is not meant as limiting. This synchronizing chain 168 is then twisted or turned slightly less than one-hundred-eighty degrees at the distal end of chain 168, and then typically engaged at the distal end to a portion of about thirty-nine sprockets 172, as also seen in FIG. 1, located on the perimeter of inner sprocket wheel 66 which is fixedly coupled to outer sprocket wheel 64. This synchronizing chain 168 now resembles a figure-eight laid on its side, as illustrated in FIG. 2. It is this twist and figure-eight feature of the synchronizing chain 168 that allows both riders to pedal forward, relative to themselves and the direction in which they sit, as noted by the direction of arrows 174, 176 in FIG. 2. Opposing rotations of the proximal and distal sprocket wheels 78, 66 are noted by arrows 178, 180. Specifically, arrow 178 shows the clockwise rotation of sprocket wheel 78, while arrow 180 shows a counterclockwise rotation of sprocket wheel 66. Arrows 182, 184 illustrate the direction of chain uptake by the respective sprocket wheels 78, 66. Without this twisted chain 168, one of the riders would have to pedal backwards which is not efficient, nor equitable for the forward pedaling rider.

Figure 3:
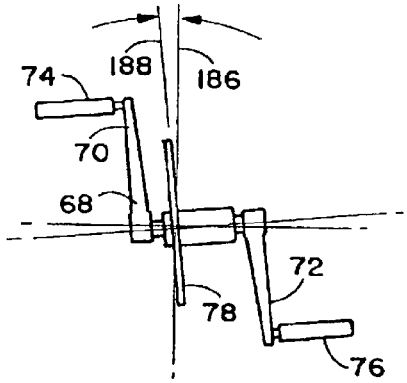
FIG. 3 is a front sectional view taken generally along line 3 of FIG. 1, of the present invention.
Figure 4:
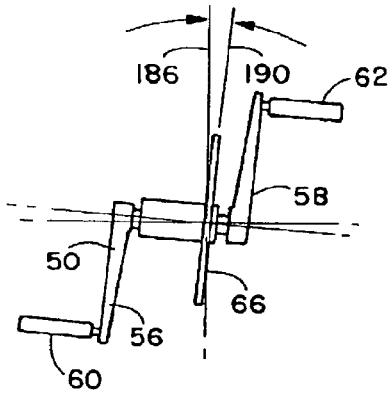
FIG. 4 is a front sectional view taken generally along line 4 of FIG. 1, of the present invention.

FIGS. 3 and 4 illustrate how the twist to the synchronizing chain 168 is maintained. In FIG. 3, the proximal sprocket wheel 78 is mounted off the vertical plane 186 and slightly negative, as indicated by line 188. The degree of angle offset is between about negative one-half and negative ten degrees. In FIG. 4, the distal sprocket wheel 66 is also mounted slightly off the vertical plane 186 but slightly positive, as indicated by line 190. The degree of angle offset is between about positive one-half and positive ten degrees. This results in both sprocket wheels 78, 66 being angled in opposite directions relative to the other. It also results in a relative difference in combined sprocket wheel angle of between about one and twenty degrees. This combined angle offset to the sprocket wheels 78, 66 is sufficient to generally prevent the sides or lengths of chain 168 from scrapping, cutting or otherwise physically contacting or damaging themselves during their close proximity at the center of the figure-eight loop.

Returning to FIG. 1 to illustrate the power transmission and transduction system, exercise power is transmitted to flywheel 16 in the following manner. Both first and second sprocket wheels 64, 66 are fixedly coupled to pedal crank 50 having crank arms 56, 58 located on either side of frame 12. Both crank arms 56, 58 are turned at the point of the attached pedals 60, 62 by the forward pedaling feet of the distal rider. Additionally, both tandem riders mutually and concurrently turn the first and second sprocket wheels 64, 66 by applying exercise motion to the handlebar crank 24 that is coupled to crank arms 56, 58. Furthermore, the proximal rider also pedals forward and turns proximal sprocket wheel 78 that is operationally coupled by the twisted synchronizing chain 168 to the second sprocket wheel 66, which turns the fixedly coupled first sprocket wheel 64.

Continuing with FIG. 1, some portion of about fifty-two sprockets 192 of the first sprocket wheel 64 are operationally engaged to "drive chain" 194. This "drive chain" 194 then engages and turns freewheel 196 that is coupled to the flywheel axle 130, which in turn spins flywheel 16. Freewheel 196 has between one to eight fixed or interchangeable sprocket wheels, which allows a corresponding number of gear ratios. Freewheel 196 with five sprocket wheels, as an example, would typically include fourteen, seventeen, twenty, twenty-four and twenty-eight sprockets. However, freewheel 196 would not be limited by only these sprocket combinations, or number of sprockets per sprocket wheel, because of the interchangeability of freewheel 196. The sprocket wheels of the freewheel 196 are selected and chain-engaged by conventional derailer system 198 manipulated by either rider by use of gear lever 200 connected by cable to the derailer 198.

A kit or kits would contain the parts and/or components of tandem exerciser 10 and optionally a power generator 146. Such kit or kits would contain a completed frame, partially assembled frame or individual frame members that would be assembled into a completed frame. The kit or kits would also contain a power train, or power transmision and transduction system that would include handlebar crank 24 or individual crank members that would be assembled into handlebar crank 24, chain-and-sprocket system 166 that includes single sprocket wheel 78, dual sprocket wheel combination 64, 66, at least two pedal cranks 50, 68, a plurality of pedals 60, 62, 74, 76, at least two chain assemblies 168, 194, flywheel 16, and belt 162 that couples the flywheel 16 to power generator 146. The power generator 146 may be twelve-volt D.C. electrical generator, A.C. electrical power generator, combinations of D.C. generator and inverter, air compressor, gas pump, fluid pump, liquid pump, water pump, or other mechanically powered equipment for cutting, milling or grinding that is well known in the art.

Having described the preferred embodiment for the apparatus of the present invention, it will be apparent to one skilled in the art that other embodiments are also easily adapted by using the concepts discussed above. Accordingly, the invention should be limited only by the spirit and scope of the appended claims.

I claim:

1. A tandem exerciser for forward pedaling and mutually facing riders comprising:

a frame having proximal and distal ends;

a flywheel rotatably coupled to the frame;

a standing support means;

a first seat mounted to the proximal end of the frame for a first user and a second seat mounted to the opposite distal end of the frame for a second user such that the seats are facing each other;

a proximal pair of foot pedals and a distal pair of foot pedals operably connected to simultaneously drive the flywheel;

proximal pedal cranks and distal pedal cranks;

a pair of handle bar cranks operably connected to the frame wherein one end of each handle bar crank is pivotally connected to a respective said distal foot pedal, an opposite end of the handle bar crank is bifurcated into handle bars such that the first and second user can simultaneously grip and actuate the handle bars, and a middle portion of the handle bar crank is pivotally coupled to a cross member of the frame thereby providing a common pivot axis for both handle bar cranks; and a power transmission means, operably mounted to the frame, having a drive mechanism that includes at least two chains, one of which is twisted less than one-hundred-eighty degrees, to allow for both users to simultaneously pedal in their respective forward directions to drive said flywheel.

2. The tandem exerciser of claim 1, wherein:

said distal end of said frame is a gantry, said gantry connected to said flywheel by a plurality of interconnected frame members.

3. The tandem exerciser of claim 1, wherein:

said standing support means is downwardly coupled to said frame and is a wheel, kick-stand, T-shaped kickstand, A-shaped kickstand, V-shaped kickstand, or U-shaped kickstand.

4. The tandem exerciser of claim 1, wherein said flywheel comprises:

an axle;

a freewheel attached centrally to said axle; and a wheel having a plurality of semicircular metal segments attached to perimeter of said wheel.

5. The tandem exerciser of claim 4, wherein:

said wheel is a bicycle wheel having attached rim weights, bicycle wheel having semicircular metal segments attached to outer rim, one-piece metal wheel, one-piece machined metal wheel, or one piece molded metal wheel.

6. The tandem exerciser of claim 4, wherein:

said freewheel is a single sprocket wheel, three interchangeable sprocket wheels, three fixed sprocket wheels, five interchangeable sprocket wheels, five fixed sprocket wheels, a plurality of interchangeable sprocket wheels, or a plurality of fixed sprocket wheels.

7. The tandem exerciser of claim 1, wherein:

said power transmission and transduction means is a chain-and-sprocket system coupled to said frame, said chain-and-sprocket system operationally coupled to the handlebar cranks and the proximal and distal pedal cranks, said chain-and-sprocket system operationally engaged to said flywheel.

8. The tandem exerciser of claim 7, wherein:

said handlebar cranks are operationally coupled to said distal pedal crank, said distal pedal cranks having first and second sprocket wheels fixedly and centrally attached;

said proximal pedal cranks have a fixedly and centrally attached sprocket wheel that is coupled by synchronized chain to said second sprocket wheel of said distal pedal cranks; and said first sprocket wheel of said distal pedal cranks is operationally coupled by drive chain to said flywheel.

9. The tandem exerciser of claim 8, wherein:

said synchronized chain is twisted less than one-hundred-eighty degrees between said sprocket wheel of said proximal pedal cranks, and said second sprocket wheel of said distal pedal cranks.

10. The tandem exerciser of claim 9, wherein:

said sprocket wheel coupled to said proximal pedal cranks is angularly offset opposite to angular offset of said second sprocket wheel coupled to said distal pedal cranks.

11. The tandem exerciser of claim 1, wherein:

said flywheel is belt coupled to a power generator.

12. The tandem exerciser of claim 1 further comprising:

a first seat adjustment means for adjusting the vertical, horizontal and rotational position of said first seat, and a second seat adjustment means for adjusting the vertical, horizontal and rotational position of said second seat, such that the relative position of said seats are adjustable.

13. The tandem exerciser of claim 12, wherein:

said first and second seat adjustment means is a seat post collar, or a quick-release seat post collar.

14. The tandem exerciser of claim 12, wherein:

said first and second seat adjustment means is comprised of first and second seat posts rotationally adjustable and inserted into first and second seat columns, thereby allowing said proximal seat and said distal seat to be facing each other.

* * * * *